US006604963B2

(12) United States Patent
Lin

(10) Patent No.: US 6,604,963 B2
(45) Date of Patent: Aug. 12, 2003

(54) POWER SUPPLY SYSTEM USED IN DESKTOP COMPUTER

(75) Inventor: Chih-Chiang Lin, Taoyuan Shien (TW)

(73) Assignee: Delta Electronics Inc., Taoyuan Shien (TW)

( * ) Notice: Subject to any disclaimer, the term of this patent is extended or adjusted under 35 U.S.C. 154(b) by 0 days.

(21) Appl. No.: 10/037,332

(22) Filed: Nov. 9, 2001

(65) Prior Publication Data

US 2003/0032330 A1 Feb. 13, 2003

(30) Foreign Application Priority Data

Aug. 13, 2001 (TW) ..... 90213796 U

(51) Int. Cl.[7] ..... H01R 13/648
(52) U.S. Cl. ..... 439/607; 439/638; 439/502
(58) Field of Search ..... 439/607, 638, 439/500, 502, 352, 357, 358

(56) References Cited

U.S. PATENT DOCUMENTS 5,402,008 A * 3/1995 St. John ..... 307/64
5,437,563 A * 8/1995 Kihira et al. ..... 439/607
5,573,425 A * 11/1996 Morisawa et al. ..... 439/502
5,578,876 A * 11/1996 Crampton ..... 307/80
5,955,797 A * 9/1999 Kim ..... 307/150
6,314,001 B1 * 11/2001 Chu ..... 361/826
6,352,504 B1 * 3/2002 Ise et al. ..... 600/300

* cited by examiner

*Primary Examiner*—Tho D. Ta
(74) *Attorney, Agent, or Firm*—Pate Pierce & Baird

(57) ABSTRACT

A power supply system including an electronic equipment, a power supply apparatus for transforming an alternating current to a direct current, a first connector electrically connected to the electronic equipment, and a second connector electrically connected to the power supply apparatus, wherein the first connector is connected to the second connector. The power supply apparatus is disposed out of a case of the electronic equipment. The first connector has a first body covered by a first metal cover and includes at least one terminal base disposed therein, and at least one conductive pin is inserted into the terminal base. The second connector has a second body covered by a second metal cover and includes at least one slot disposed therein corresponding to the terminal base, and at least one conductive terminal is inserted into the slot corresponding to the conductive pin.

15 Claims, 6 Drawing Sheets

POWER SUPPLY SYSTEM USED IN DESKTOP COMPUTER

FIELD OF THE INVENTION

The present invention relates to a power supply system, and more particularly to a power supply system used for transmitting high power source to a desktop computer.

BACKGROUND OF THE INVENTION

The conventional desktop computer generally includes a power supply disposed in the interior of the computer case for rectifying and transforming the commercial power source into a direct current (DC), which is employed by the electronic devices on the motherboard of the computer case.

However, for the market demand of a high efficient desktop computer, such as faster operation speed and smaller volume, the layout and heat-dissipation of the electronic device on the motherboard become an important issue. Generally, the power supply apparatus will occupy a lot of internal space in the computer case and produce a huge heat. Therefore, those restrict the development of the high efficient desktop computer. Furthermore, the layout and heat problems are hard to overcome in the limited internal space of the computer case.

Therefore, the purpose of the present invention is to develop a power supply system to deal with the above situations encountered in the prior art.

SUMMARY OF THE INVENTION

It is therefore an object of the present invention to provide a power supply system including a power supply apparatus disposed out of a case of an electronic equipment for saving the internal space to expand the circuit layout or decreasing the case size of the electronic equipment.

It is therefore another object of the present invention to provide a power supply system including a power supply apparatus disposed out of a case of an electronic equipment for increasing the flexibility of heat-dissipating design and enhancing the heat-dissipating effect.

It is therefore an additional object of the present invention to provide a power supply system including a connector connected a power supply apparatus with an electronic equipment for increasing transmitted current, preventing from the interference of the electromagnetic wave, and providing the function of the electrical static defense.

According to an aspect of the present invention, there is provided a power supply system including an electronic equipment, a power supply apparatus for transforming an alternating current to a direct current, a first connector electrically connected to the electronic equipment, and a second connector electrically connected to the power supply apparatus, when the first connector is connected to the second connector, the direct current is transmitted to the electronic equipment from the power supply apparatus. In addition, the power supply apparatus is disposed out of a case of the electronic equipment. The first connector has a first body covered by a first metal cover and includes at least one terminal base disposed therein, and at least one conductive pin is inserted into the at least one terminal base, wherein the number of the conductive pin is less than the number of the terminal base. The second connector has a second body covered by a second metal cover and includes at least one slot disposed therein corresponding to the at least one terminal base, and at least one conductive terminal is inserted into the at least one slot corresponding to the at least one conductive pin.

For example, the electronic equipment is a desktop computer.

For example, the power supply apparatus is an adapter.

Preferably, the first body and the second body are made of an insulating material.

Preferably, the first body further includes an elastic buckling element. The second body preferably further includes a protruding element corresponding to the elastic buckling element for buckling the first body and the second body together.

Preferably, the power supply apparatus has an output power larger than 100 watt.

According to another aspect of the present invention, there is provided a power supply system including an electronic equipment, a power supply apparatus for transforming an alternating current to a direct current, a first connector electrically connected to the power supply apparatus, and a second connector electrically connected to the electronic equipment, when the first connector is connected to the second connector, the direct current is transmitted to the electronic equipment from the power supply apparatus. In addition, the power supply apparatus is disposed out of a case of the electronic equipment. The first connector has a first body covered by a first metal cover and includes at least one terminal base disposed therein, and at least one conductive pin is inserted into the at least one terminal base, wherein the number of the conductive pin is smaller than the number of the terminal base. The second connector has a second body covered by a second metal cover and includes at least one slot disposed therein corresponding to the at least one terminal base, and at least one conductive terminal is inserted into the at least one slot corresponding to the at least one conductive pin.

According to an additional aspect of the present invention, there is provided a power supply system including a desktop computer, an adapter for transforming an alternating current to a direct current, a first connector electrically connected to the desktop computer, and a second connector electrically connected to the adapter, when the first connector is connected to the second connector, the direct current is transmitted to the desktop computer from the adapter. The adapter is disposed out of a case of the desktop computer. The first connector has a first body covered by a first metal cover and includes at least one terminal base disposed therein, and at least one conductive pin is inserted into the at least one terminal base, wherein the number of the conductive pin is less than the number of the terminal base. The second connector has a second body covered by a second metal cover and includes at least one slot disposed therein corresponding to the at least one terminal base, and a conductive terminal is inserted into the at least one slot corresponding to the at least one conductive pin.

Preferably, the first body and the second body are made of an insulating material.

Preferably, the first body further includes an elastic buckling element. The second body preferably further includes a protruding element corresponding to the elastic buckling element for buckling the first body and the second body together.

Preferably, the power supply apparatus has an output power larger than 100 watt.

The present invention may best be understood through the following description with reference to the accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
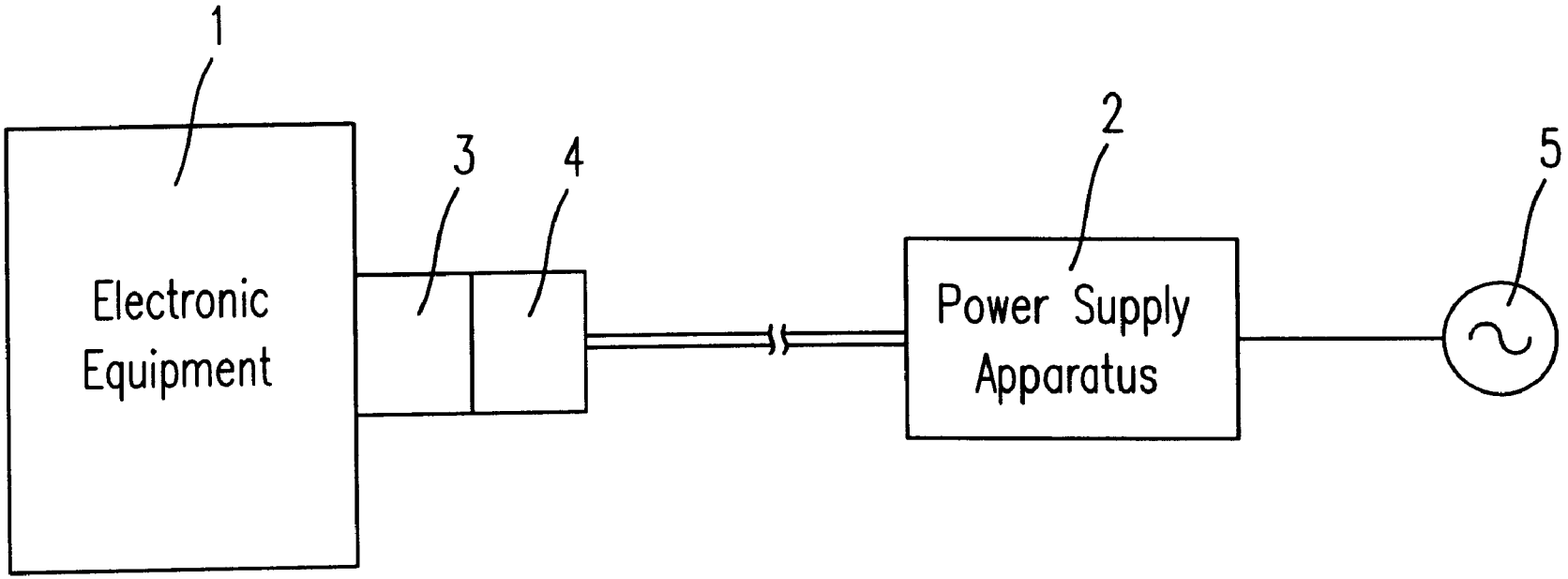
FIG. 1 is a functional block diagram illustrating a preferred embodiment of a power supply system according to the present invention.

FIG. 1 is a functional block diagram illustrating a preferred embodiment of a power supply system according to the present invention. The power supply system is applied in a power supply system with an output power larger than 100 watt. As shown in FIG. 1, the power supply system includes an electronic equipment 1, a power supply apparatus 2, a first connector 3 and a second connector 4. The power supply apparatus 2, such as an adapter, is used for transforming an input alternating current into a direct current transmitted to the electronic equipment 1, such as a desktop computer, by the first and second connectors 3, 4. The operation principle of power supply apparatus is well known to those skilled in the art, so that detailed description is omitted herein.

Figure 2A:
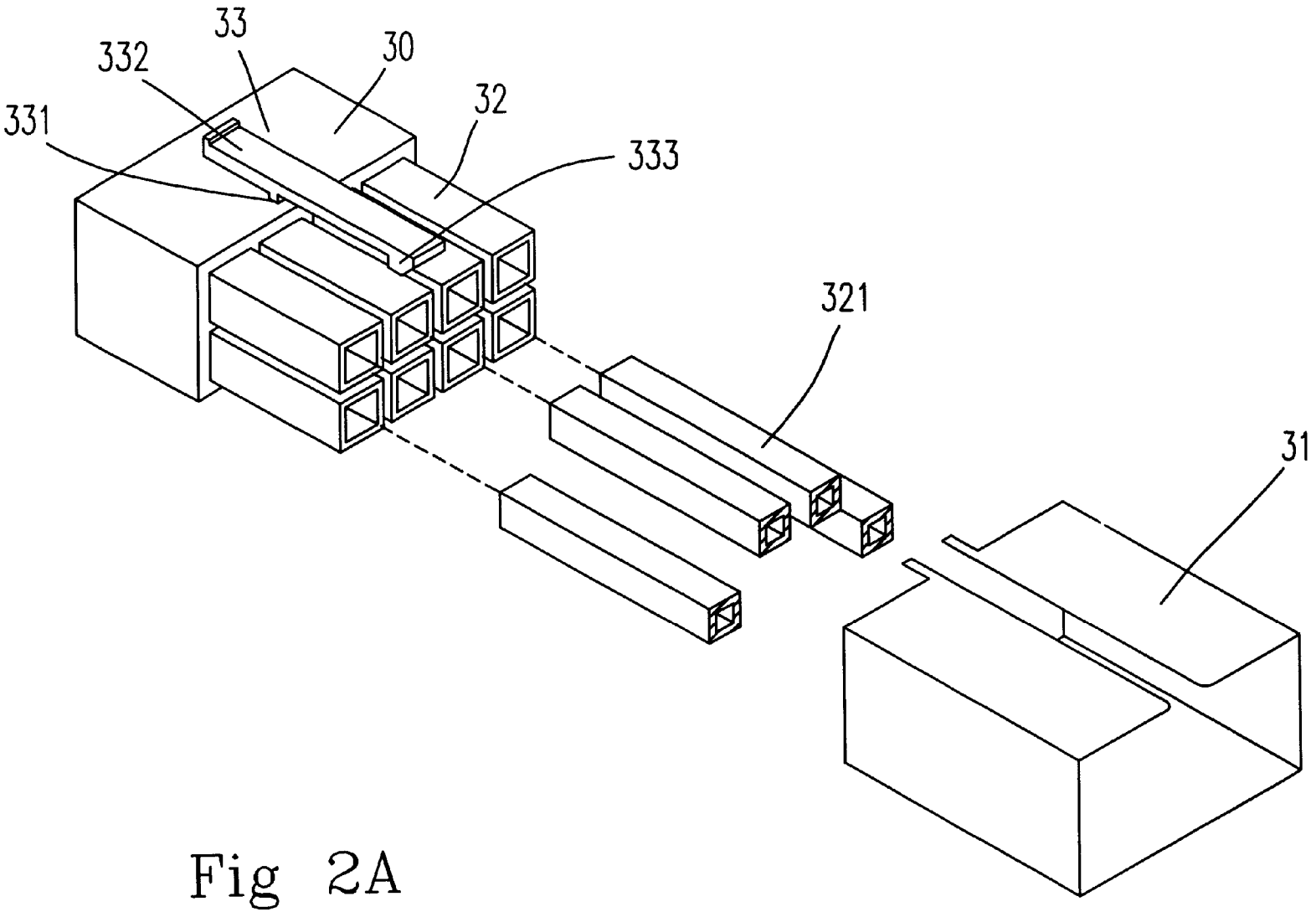
FIGS. 2A–2B are a decomposed diagram and an assembly diagram illustrating the first connector in FIG. 1.
Figure 2B:
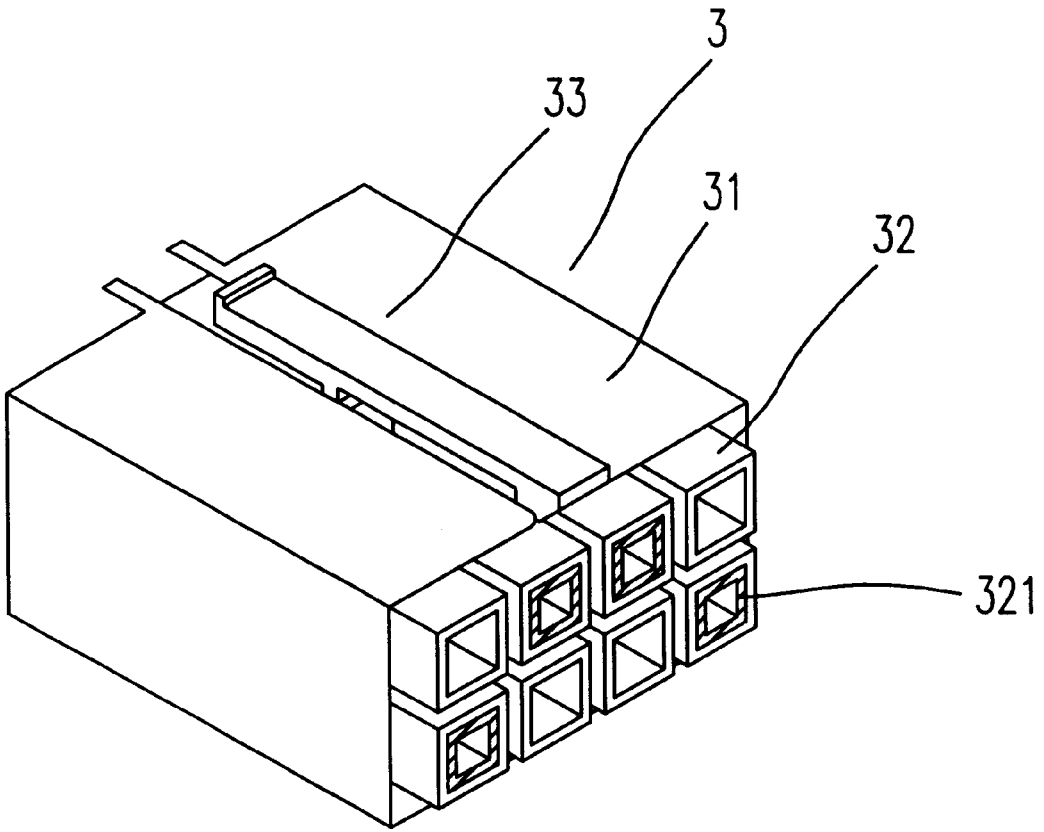

FIGS. 2A–2B are a decomposed diagram and an assembly diagram illustrating the first connector in FIG. 1. The first connector 3 has a first body 30 made of plastic and formed by molding. The first body 30 is covered by a first metal cover 31 for sheltering from the interference of external electromagnetic wave. A plurality of terminal bases 32 is disposed in the interior of the first body 30 and conductive pins 321 are inserted into partial terminal bases 32. The conductive pins 321 is connected to the corresponding electronic wires 13 as shown in FIG. 4 for transmitting current to the electronic equipment 1.

Figure 3A:
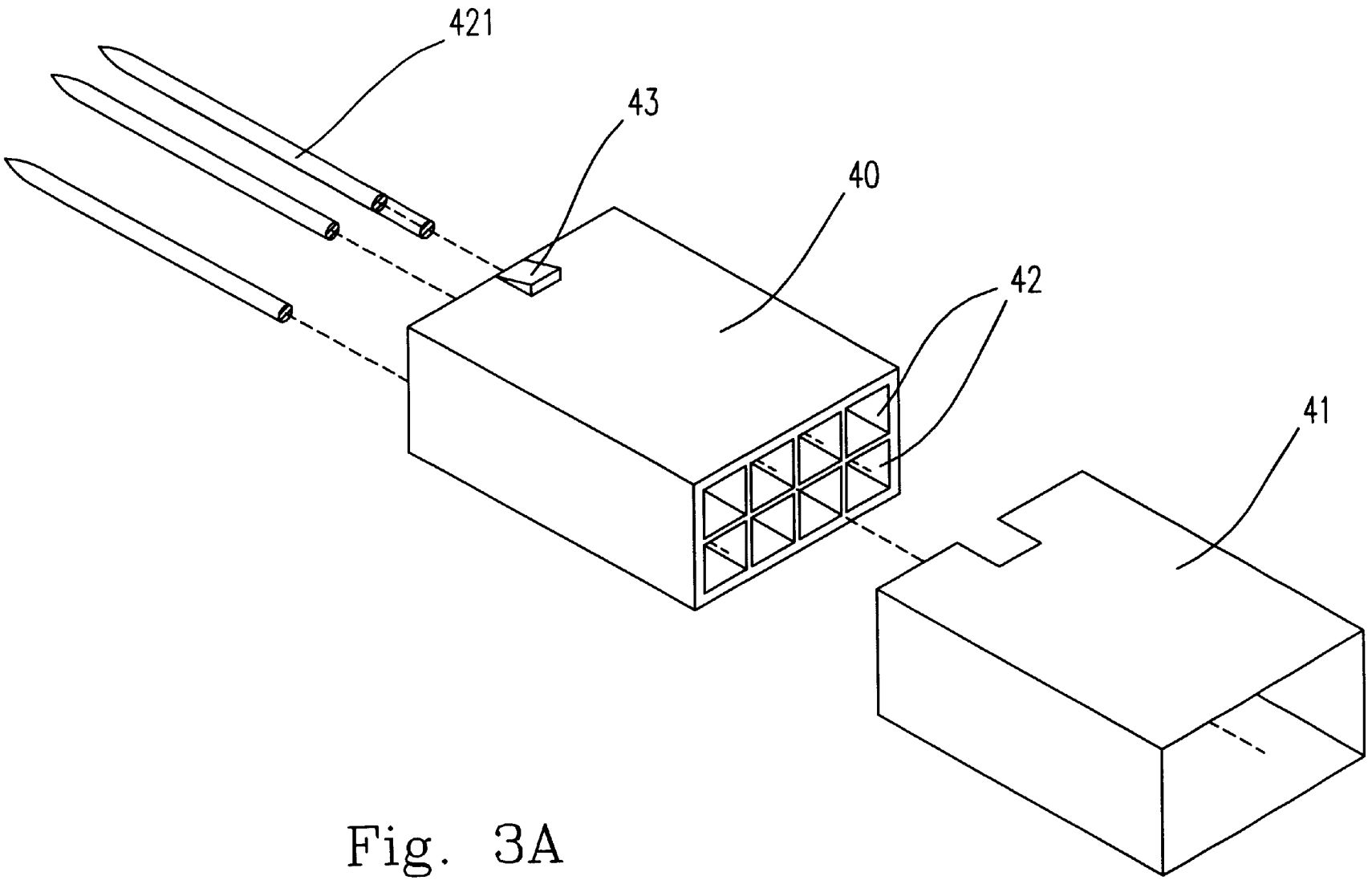
FIGS. 3A–3B are a decomposed diagram and an assembly diagram illustrating the second connector in FIG. 1.
Figure 3B:
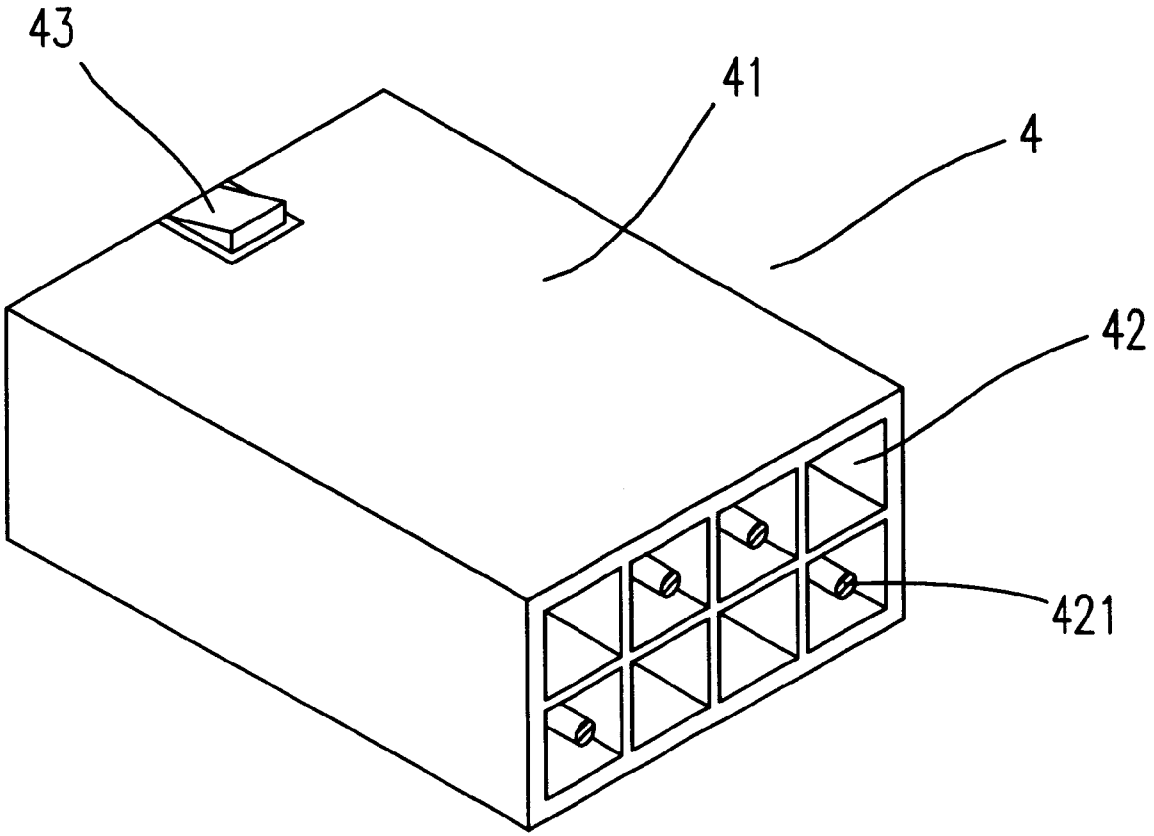

FIGS. 3A–3B are a decomposed diagram and an assembly diagram illustrating the second connector in FIG. 1. The second connector 4 has a second body 40 made of plastic and formed by molding. The second body is covered by a second metal cover 41 for also sheltering from the interference of external electromagnetic wave. A plurality of slots 42 is disposed inside of the second body 40 and corresponding to the partial conductive pins 321. Conductive terminals 421 are inserted into the slots 42 and connected to the corresponding electronic wires 24 as shown in FIG. 4 for receiving current from the power supply apparatus 1.

In addition, an elastic buckling element 33 is disposed on the first body 30 as shown in FIGS. 2A and 2B and integrally formed with the first body 30. Furthermore, a protruding element 43 corresponding to the elastic buckling element 33 is disposed on the second body 40 as shown in FIGS. 3A and 3B and integrally formed with the second body 40. The elastic buckling element 33 includes a support portion 331, a suppress portion 332 and a buckling portion 333. When the suppress portion 332 is pressed down, the buckling portion 333 will upwardly move. When the force is released, the buckling portion 33 will be back to the original position. Thus, the elastic buckling element 33 can buckle with the protruding element 43 each other.

Figure 4:
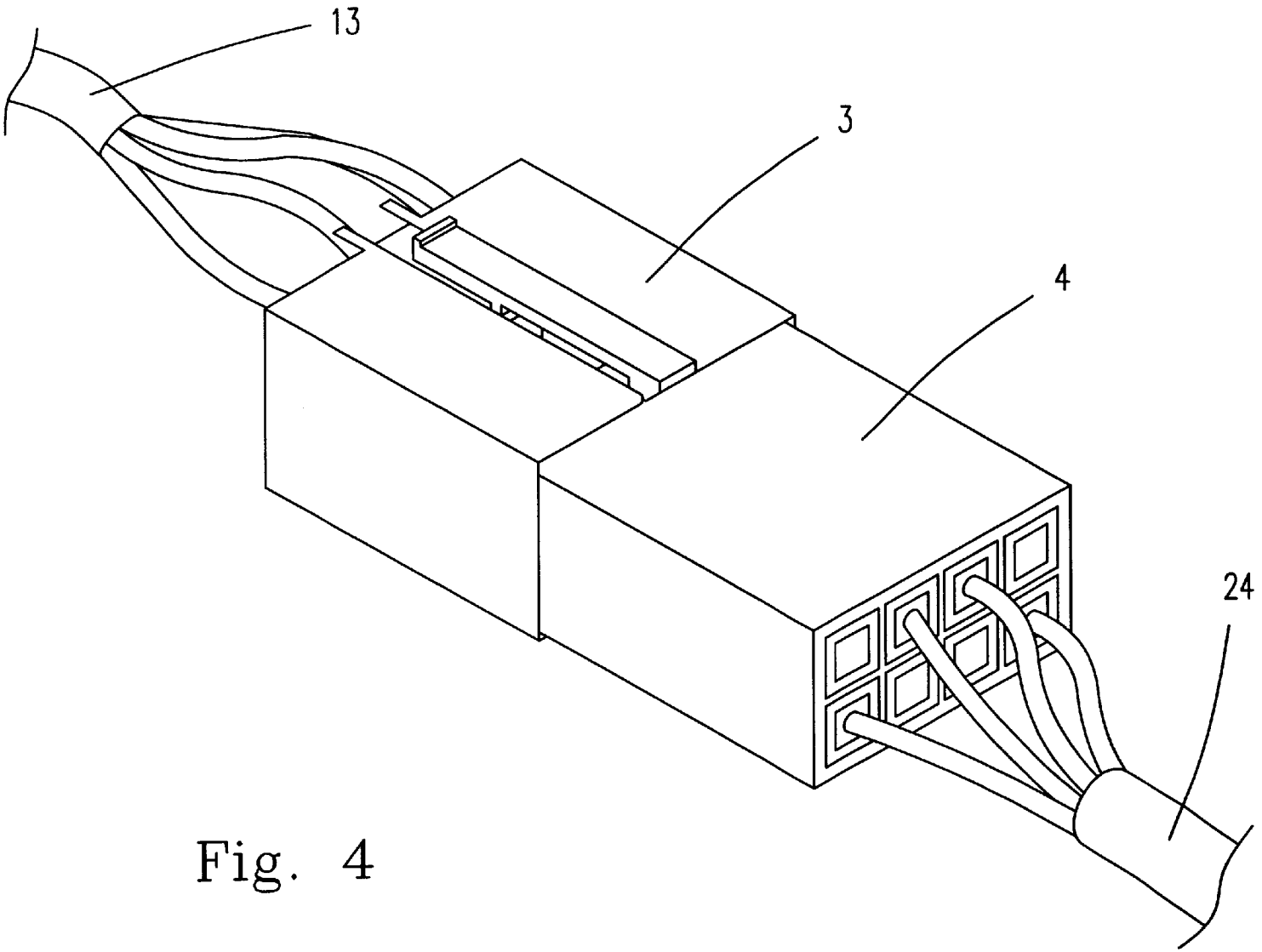
FIG. 4 is an assembly diagram illustrating the combination of the first connector and the second connector according to the present invention.

FIG. 4 is an assembly diagram illustrating the combination of the first connector and the second connector according to the present invention. As shown in FIG. 4, when the terminal bases are combined with the slots 42 and the conductive pins 321 are contacted with the conductive terminals 421, the first connector 3 and the second connector 4 are combined together by buckling the elastic buckling element 33 with the protruding element 43.

For the practical requirement, the numbers of the terminal bases and the slots can be increased or reduced. At the same time, the numbers of the conductive pins and the conductive terminals also have to cooperatively increase for increasing output.

In sum, the present invention provides that the power supply apparatus is disposed out of the case of the electronic equipment for increasing the internal space of the electronic equipment for the circuit outlet, increasing the efficiency of the electronic equipment, and enhancing heat-dissipating effect wherein the electronic equipment includes no power supply apparatus therein. Owing to save the internal space of the electronic equipment such as desktop computer, the desktop computer is miniaturized and has high performance because the motherboard can expand the circuit layout or the case size of the desktop computer can be reduced. Furthermore, because the power supply apparatus is one of heat-generating unit in the desktop computer, the present invention can reduce the heat-generating unit in the case for efficiently increasing the efficiency and stability of the desktop computer. In addition, the connecter according to the present invention can increase the transmitted current, efficiently prevent from the interference of the electromagnetic wave. Moreover, the first metal cover of the first connector can guide the static electricity transmitted to the second metal cover of the second connector and further transmitted to the case to grounding, so the present invention provides the function of the electrical static defense (ESD).

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power supply system comprising:

an electronic equipment without a power supply apparatus therein;

a power supply apparatus for transforming an alternating current to a direct current;

a first connector electrically connected to said electronic equipment; and a second connector electrically connected to said power supply apparatus;

when said first connector is connected to said second connector, said direct current is transmitted to said electronic equipment from said power supply apparatus, wherein:

said power supply apparatus is disposed out of a case of said electronic equipment;

said first connector has a first body covered by a first metal cover and includes at least one terminal base disposed therein, and at least one conductive pin is inserted into said at least one terminal base, wherein the number of said conductive pin is less than the number of said terminal base; and said second connector has a second body covered by a second metal cover and includes at least one slot disposed therein corresponding to said at least one terminal base, and at least one conductive terminal is inserted into said at least one slot corresponding to said at least one conductive pin.

2. The power supply system according to claim 1 wherein said electronic equipment is a desktop computer.

3. The power supply system according to claim 1 wherein said power supply apparatus is an adapter.

4. The power supply system according to claim 1 wherein said first body is made of an insulating material.

5. The power supply system according to claim 1 wherein said second body is made of an insulating material.

6. The power supply system according to claim 1 wherein said power supply apparatus has an output power larger than 100 watt.

7. The power supply system according to claim 1 wherein said first body further includes an elastic buckling element.

8. The power supply system according to claim 7 wherein said second body further includes a protruding element corresponding to said elastic buckling element for buckling said first body and said second body together.

9. A power supply system comprising:

an electronic equipment without a power supply apparatus therein;

a power supply apparatus for transforming an alternating current to a direct current;

a first connector electrically connected to said power supply apparatus; and a second connector electrically connected to said electronic equipment;

when said first connector is connected to said second connector, said direct current is transmitted to said electronic equipment from said power supply apparatus, wherein:

said power supply apparatus is disposed out of a case of said electronic equipment;

said first connector has a first body covered by a first metal cover and includes at least one terminal base disposed therein, and at least one conductive pin is inserted into said at least one terminal base, wherein the number of said conductive pin is less than the number of said terminal base; and said second connector has a second body covered by a second metal cover and includes at least one slot disposed therein corresponding to said at least one terminal base, and at least one conductive terminal is inserted into said at least one slot corresponding to said at least one conductive pin.

10. A power supply system comprising:

a desktop computer without a power supply apparatus therein;

an adapter for transforming an alternating current to a direct current, a first connector electrically connected to said desktop computer; and a second connector electrically connected to said adapter;

when said first connector is connected to said second connector, said direct current is transmitted to said desktop computer from said adapter, wherein:

said adapter is disposed out of a case of said desktop computer;

said first connector has a first body covered by a first metal cover and includes at least one terminal base disposed therein, and at least one conductive pin is inserted into said at least one terminal base, wherein the number of said conductive pin is less than the number of said terminal base; and said second connector has a second body covered by a second metal cover and includes at least one slot disposed therein corresponding to said at least one terminal base, and a conductive terminal is inserted into said at least one slot corresponding to said at least one conductive pin.

11. The power supply system according to claim 10 wherein said first body is made of an insulating material.

12. The power supply system according to claim 10 wherein said second body is made of an insulating material.

13. The power supply system according to claim 10 wherein said power supply apparatus has an output power larger than 100 watt.

14. The power supply system according to claim 10 wherein said first body further includes an elastic buckling element.

15. The power supply system according to claim 14 wherein said second body further includes a protruding element corresponding to said elastic buckling element for buckling said first body and said second body together.

* * * * *